US007530851B2

(12) United States Patent
Parnis

(10) Patent No.: US 7,530,851 B2
(45) Date of Patent: May 12, 2009

(54) VEHICLE ACCESSORY CONTROL SYSTEM

(75) Inventor: William R. Parnis, Livonia, MI (US)

(73) Assignee: Check Corporation, Troy, MI (US)

( * ) Notice: Subject to any disclaimer, the term of this patent is extended or adjusted under 35 U.S.C. 154(b) by 0 days.

(21) Appl. No.: 11/673,937

(22) Filed: Feb. 12, 2007

(65) Prior Publication Data

US 2008/0191550 A1 Aug. 14, 2008

(51) Int. Cl.
*H01R 13/68* (2006.01)

(52) U.S. Cl. ..... 439/620.29; 439/620.27; 439/622

(58) Field of Classification Search ..... 439/620.29, 439/488, 620.21, 620.31, 622, 620.27; 324/550; 307/9.1

See application file for complete search history.

(56) References Cited

U.S. PATENT DOCUMENTS

| | | | | |
|---|---|---|---|---|
| 5,030,916 | A * | 7/1991 | Bokitch | 324/503 |
| 5,125,855 | A | 6/1992 | Brooks | |
| 6,429,663 | B1 * | 8/2002 | LaCoste | 324/550 |
| 6,457,995 | B1 * | 10/2002 | Brooks | 439/620.29 |
| 6,940,021 | B2 * | 9/2005 | Pohl et al. | 174/137 R |
| 7,148,698 | B2 * | 12/2006 | Becker et al. | 324/550 |

* cited by examiner

*Primary Examiner*—Michael C Zarroli
(74) *Attorney, Agent, or Firm*—Reising Ethington P.C.

(57) ABSTRACT

A control system for an accessory in a vehicle includes an adapter, a monitoring circuit, and a controller. The adapter couples with a fused power source. The monitoring circuit is coupled to the adapter and the controller is coupled to the adapter and the monitoring circuit. The control system provides a method of powering a vehicle accessory. The method monitors the amount of power drawn by a circuit connected to a power source and determines if the amount of power drawn is less than a threshold. Power is provided to the accessory based on the determination.

29 Claims, 7 Drawing Sheets

VEHICLE ACCESSORY CONTROL SYSTEM

FIELD OF THE INVENTION

This invention relates generally to vehicle accessories and, in particular, to adapters and controllers for vehicle accessories.

BACKGROUND OF THE INVENTION

Vehicles commonly have a power distribution box to provide power to various electrical circuits within the vehicle and to provide power-limiting devices, such as fuses and circuit breakers, to the circuits. The power-limiting devices prevent too much power from being drawn through the wires in the circuits. Connecting new devices to the power distribution box can be difficult because most power distribution boxes do not provide an interface for aftermarket devices.

Instead, vehicles typically have vehicle power outlets, often in the form of a cigar lighter, to power aftermarket devices within the vehicle. The outlets usually interface with the power distribution box to limit the power drawn through the outlet. The outlets receive plugs attached to portable devices. But the connection from the outlet to the plugs is intended to be temporary and the plugs are easily removed from the outlets. Some vehicle accessories are intended to be permanently installed in a vehicle, however, and therefore, it may be desirable to provide a more permanent connection to power the accessory. It may also be desirable to keep the outlet available for other devices. Moreover, some accessories require a high power draw. The use of such accessories while other devices are connected to the same circuit as the outlet may exceed the limit on the power-limiting device and cause it to cut off power to the circuit.

SUMMARY OF THE INVENTION

An adapter for an accessory in a vehicle includes a plug, a socket, and a circuit. The plug electrically couples the adapter with a socket in a vehicle power distribution box. The socket on the adapter is electrically coupled with the plug and receives a fuse. The circuit is electrically coupled with the socket on the adapter to monitor the amount of power drawn through the adapter, and may generate a signal.

In another implementation, the adapter includes a first connector, a second connector, and a circuit. The first connector couples the adapter with a vehicle power outlet and the second connector couples the adapter with an electrical connector adapted to connect to the vehicle power outlet. The circuit electrically monitors the amount of power drawn through the adapter and generates a signal.

In another implementation, a control system for a vehicle accessory includes an adapter, a monitoring circuit, and a control circuit. The adapter is coupled with a circuit connected to a vehicle power box. The monitoring circuit is coupled with the adapter for generating a monitoring signal, and the control circuit is coupled with the monitoring circuit to receive the monitoring signal.

In yet another implementation, the control system includes an adapter, a monitoring circuit, and a control circuit. The adapter is coupled with a fused power source. The monitoring circuit is coupled with the adapter for generating a monitoring signal, and the control circuit is coupled with the adapter and the monitoring circuit.

According to another implementation, a method of providing power to a vehicle accessory comprises the steps of: electrically coupling an adapter with a circuit connected to a power source; monitoring the amount of power drawn by the circuit; and generating a signal representative of the amount of power drawn.

According to yet another implementation, a method of powering a vehicle accessory comprises the steps of: electrically coupling an adapter with a circuit connected to a power source; monitoring the amount of power drawn by the circuit; determining if the amount of power drawn is less than a first limit and less than a second limit; and providing power to the vehicle accessory based on the determination.

BRIEF DESCRIPTION OF THE DRAWINGS

Some potential objects, features and advantages of the present invention will be apparent from the following detailed description of the preferred embodiments and best mode, appended claims and accompanying drawings in which:

DETAILED DESCRIPTION OF PREFERRED EMBODIMENTS

Figure 1:
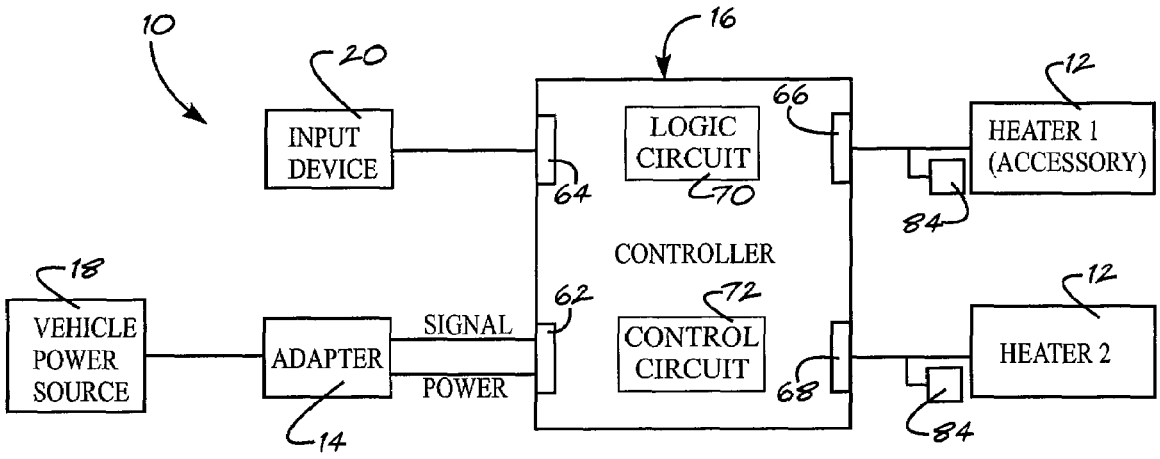
FIG. 1 is a block diagram of an embodiment of a control system for a vehicle accessory.

Referring in more detail to the drawings, FIG. 1 illustrates one embodiment of a control system 10 for an accessory 12 in a vehicle. The control system 10 includes an adapter 14 and a controller 16. The adapter 14 interfaces with a vehicle power distribution box 18 to provide power to the vehicle accessory 12 and monitor power drawn through the adapter 14. The controller 16 interfaces with the vehicle accessory 12 to control the vehicle accessory using power provided through the adapter 14. In the embodiment shown in FIG. 1, the vehicle accessory 12 includes two seat heaters. The controller 16 may be adapted, however, to interface with any number of seat heaters 12 and a variety of other types of vehicle accessories 12. FIG. 1 also shows an optional input device 20 coupled with the controller 16. The input device 20 may be any device capable of providing inputs, such as analog or digital signals, to the controller 16 to command the controller how to operate the vehicle accessory 12. Some examples of input devices 20 include switches, push buttons, touch screens, voice recognition devices, and the like. In one embodiment, the input device 20 includes switches to determine the power level applied to each seat heater 12. The input device 20 may also include an output to the user, such as a digital display or LED, to provide feedback to the user.

Figure 2:
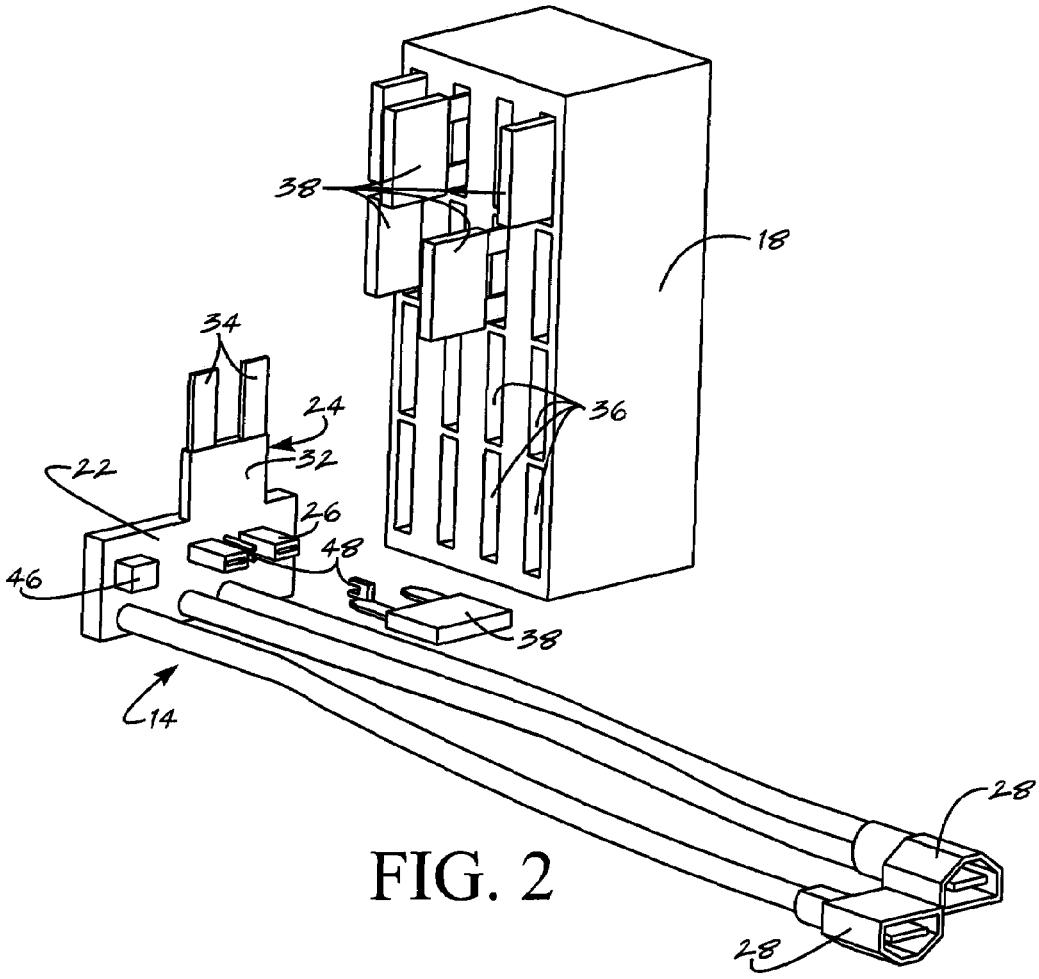
FIG. 2 is a perspective view of an embodiment of an adapter for providing power to a vehicle accessory.
Figure 3:
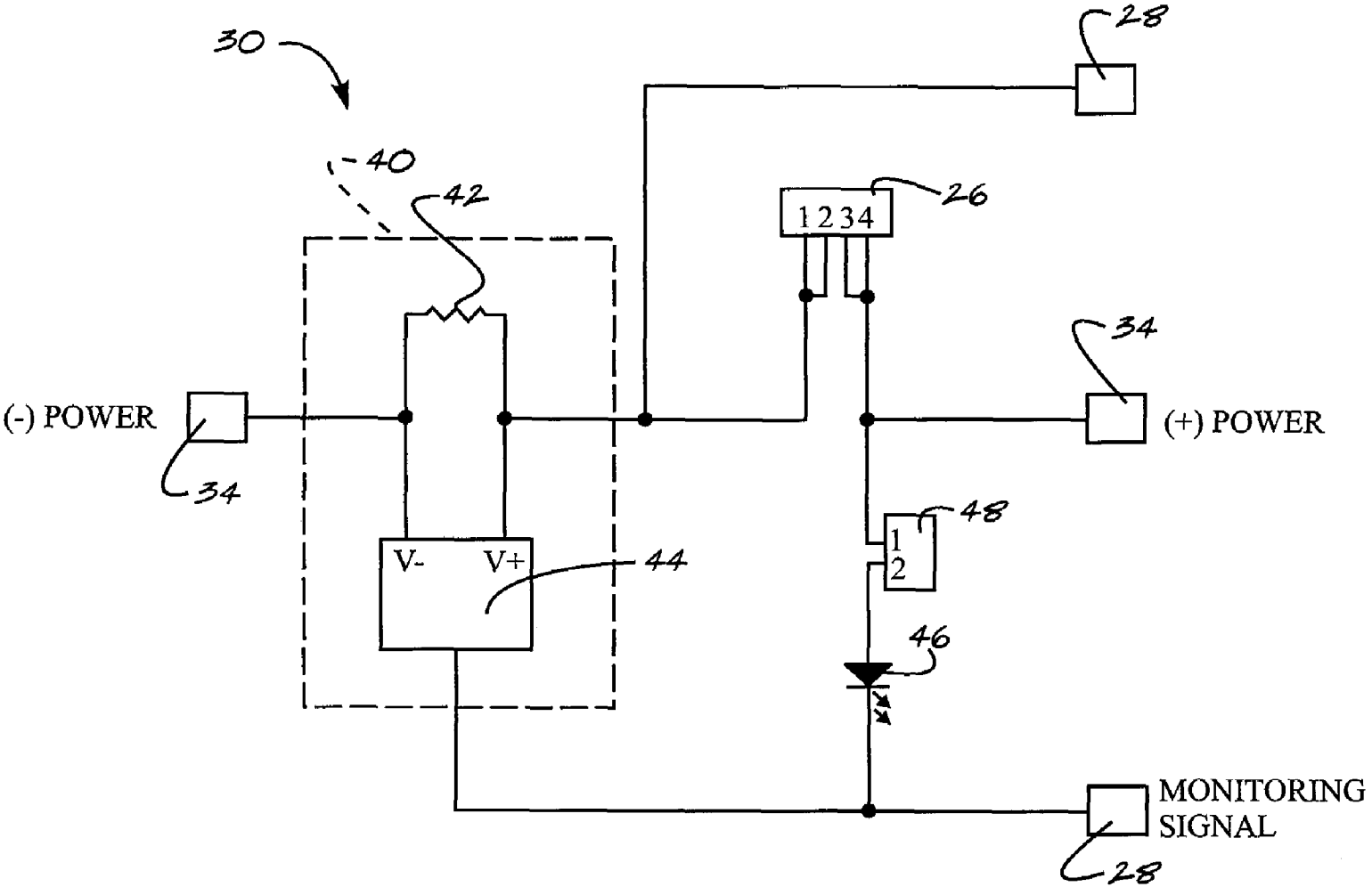
FIG. 3 is a schematic of an embodiment of a circuit for use with the adapter of FIG. 2.

FIG. 2 shows one embodiment of the adapter 14. The adapter 14 includes a substrate, carrier, or housing 22, a plug 24, a socket 26, a connector 28, and a monitoring circuit 30 (FIG. 3). The housing 22 contains the monitoring circuit 30 and may be composed of metal, plastic, or any other suitable material. A pair of wires extends from the housing 22 to the plug 24 to couple the plug with the monitoring circuit 30. In one embodiment, the plug 24 contains a body 32 extending from the housing 22 and two metal prongs 34 extending from the body. The prongs 34 and the body 32 are adapted to fit into a fuse-receiving socket 36 in the vehicle's power distribution box 18. Specifically, the body 32 may extend a sufficient distance below the housing 22 and allow the housing to extend over a fuse connected to a fuse-receiving socket 36 adjacent to the plug 24 in the power distribution box 18. In another embodiment, the plug 24 may be a cylindrically shaped body having a metallic cap at each end of the body. The body and the metallic caps fit into fuse-receiving sockets 36 adapted to receive cylindrically shaped fuses in the power distribution box 18.

The housing 22 supports the socket 26 and the socket electrically couples with the monitoring circuit 30. The socket 26 may contain electrical connectors supported by the shell and adapted to receive power-limiting device 38. In one embodiment, the power-limiting device is a fuse 38 adapted for use with the power distribution box 18. In another embodiment, the power-limiting device 38 is a circuit breaker. The power-limiting device 38 creates an open circuit when the amount of power or current flowing through the device is greater than a threshold.

The connector 28 is coupled to the monitoring circuit 30 inside the housing 22 and is adapted for interfacing with the controller 16. The connector 28 may include several pins for providing several electrical signals to the controller 16.

FIG. 3 shows one embodiment of monitoring circuit 30. The monitoring circuit 30 is electrically coupled to the plug 24, the socket 26, and the controller 16. Current from the power distribution box 18 enters the monitoring circuit 30 through the plug 24. The socket 26 connects in series with the plug 24 such that all current flowing to the controller 16 and to the vehicle circuit passes through the socket 26. Thus, the total amount of power flowing to the controller 16 and the vehicle circuit cannot exceed the threshold. The monitoring circuit 30 also includes a power-monitoring device 40 to monitor the amount of power drawn through the adapter 14. In one embodiment, the power-monitoring device 40 monitors the amount of current flowing through a portion of the monitoring circuit 30 and provides a monitoring signal representative of that amount of current. FIG. 3 illustrates one embodiment of the power-monitoring device 40, which includes a resistor 42 having a known resistance located in parallel with a monitoring chip 44. The chip 44 measures the voltage drop across the resistor 42, calculates the amount of current flowing through the resistor, and generates the monitoring signal representative of that amount of current. An example of such a chip is the ZXCT1000 Series from Zetex Semiconductors. In one embodiment, the monitoring signal is a ground referenced current whose value is representative of the measured current amount. Alternatively, the monitoring signal can be a voltage scaled to represent the measured current. In the embodiment shown in FIG. 3, the power-monitoring device 40 is located in the monitoring circuit 30 in parallel with the output to the controller 16. The only current flowing through the power-monitoring device 40 is the current drawn by the vehicle circuit and not by the controller 16. Therefore, the power-monitoring device 40 monitors the power drawn by the vehicle circuit and not by the controller 16. In another embodiment, the power-monitoring device 40 may measure the total power drawn by both the controller 16 and that vehicle circuit by placing it in series with the socket 26.

In one alternative, the monitoring circuit 30 may also include an indicator 46, such as an LED, supported by the housing 22. In one embodiment, the LED 46 is located in the monitoring circuit 30 between the plug 24 and the socket 26. In this location, the LED 46 indicates whether the plug 24 is seated in the proper orientation in the power distribution box 18 and whether the plug is receiving power from the power distribution box. If the plug 24 is reversed or seated in the wrong polarity, the monitoring circuit 30 may not function properly and the LED 46 will not light up. Alternatively, the LED 46 may be located after the socket 26 to indicate when power from the power distribution box 18 is flowing through the power-limiting device 38. FIG. 3 also shows an optional switch 48, in the form of a jumper, that may be provided in series with the LED 46 to deactivate the LED once adapter 14 has been properly configured in the system 10. Alternatively, the switch 48 may be in the form of a toggle switch, a button, or any other suitable component.

In operation, a fuse 38 is removed from a fuse-receiving socket 36 in the power distribution box 18. The plug 24 is inserted into the fuse-receiving socket 36 to couple the adapter 14 to the power distribution box 18. The fuse-receiving socket 36 in the power distribution box 18 provides power to a vehicle circuit connected to the fuse-receiving socket 36. Thus, connecting the plug 24 to the power distribution box 18 electrically couples the adapter 14 with a vehicle circuit and provides the control system 10 with power from the power distribution box 18. When the switch 48 enables the LED 46, the LED glows to indicate that the adapter 14 is properly seated in the fuse-receiving socket 38 and is receiving power from the power distribution box 18. The switch 48 may then be flipped to disable the LED 46. Next, the fuse 38 (removed from the power distribution box) may be inserted into socket 26. The fuse 38 completes the monitoring circuit 30 and the vehicle circuit, allowing power to flow from the power distribution box 18, through the monitoring circuit, and to both the connector 28 and the vehicle circuit. The power-monitoring device 40 measures the power drawn by the vehicle circuit and generates the monitoring signal for use by the controller 16.

Figure 4:
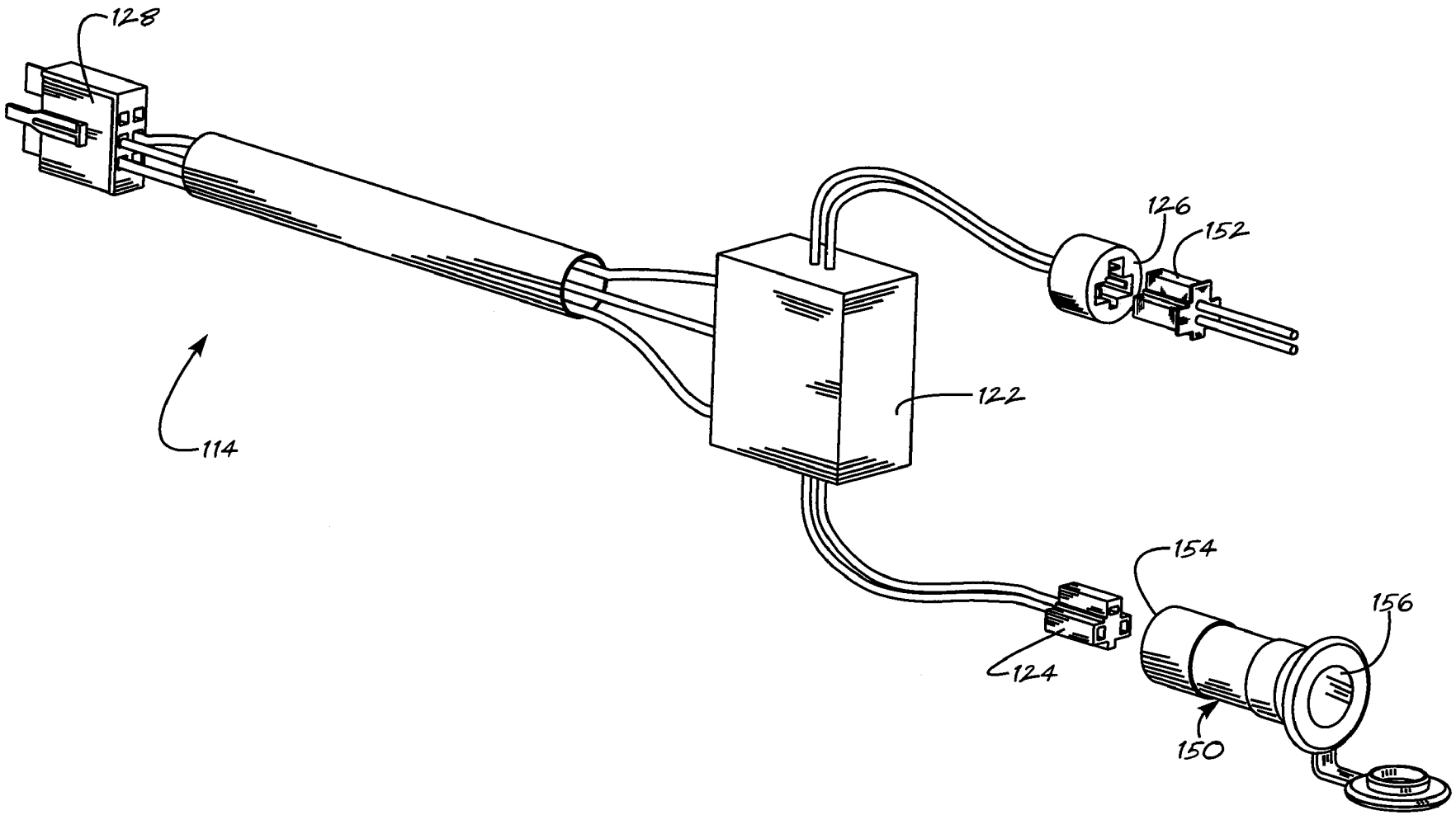
FIG. 4 is a perspective view of another embodiment of an adapter for providing power to a vehicle accessory.
Figure 5:
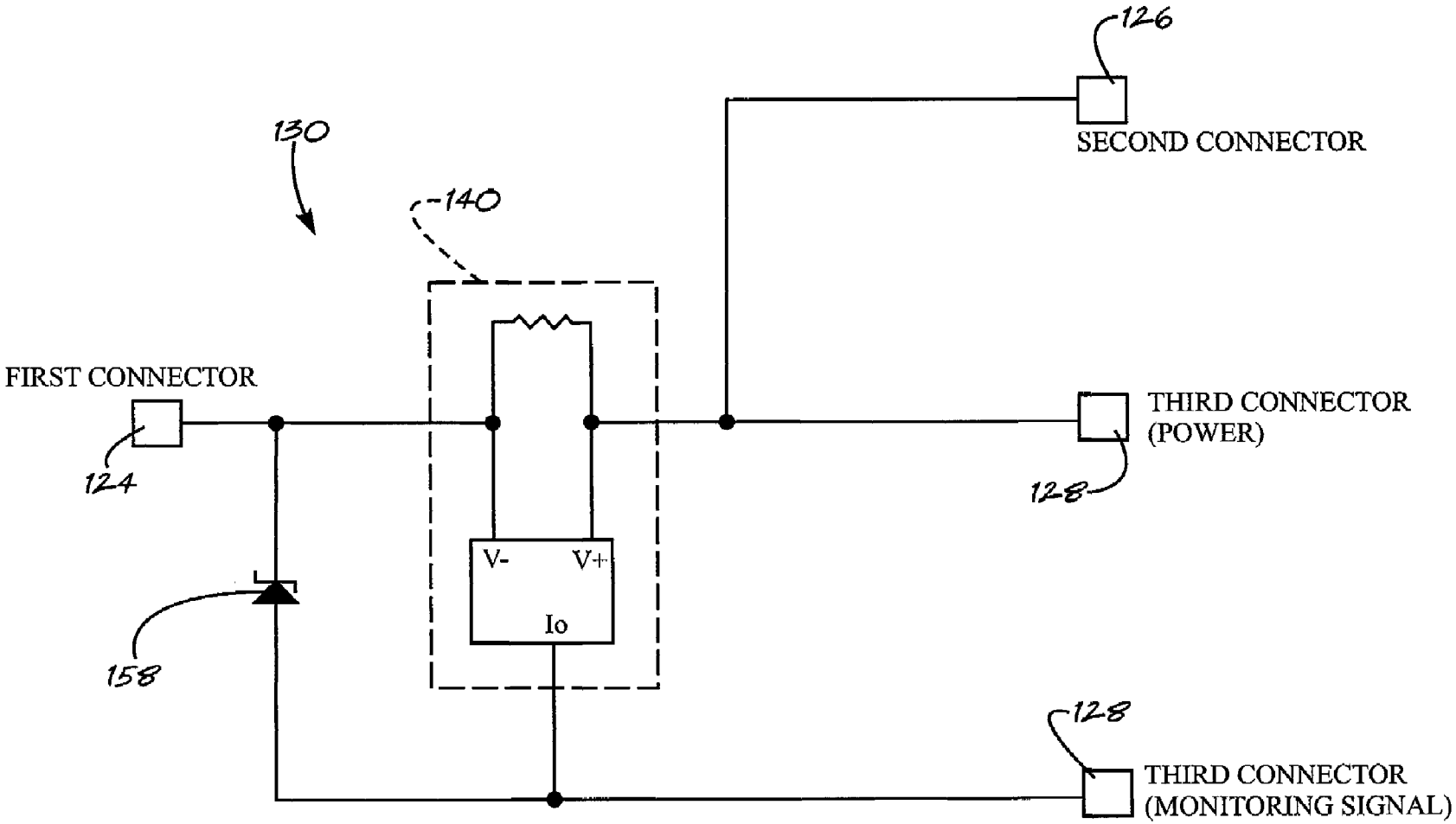
FIG. 5 is a schematic of an embodiment of a circuit for use with the adapter of FIG. 4.

FIG. 4 shows an alternative embodiment of an adapter 114 for the control system 10. The adapter 114 couples with a circuit for powering a vehicle power outlet 150. The vehicle power outlet 150 may include a vehicle cigar/cigarette lighter or any other type of vehicle power outlets. The adapter 114 includes a housing 122, a first connector 124, a second connector 126, a third connector 128, and a monitoring circuit 130 (FIG. 5). The housing 122 encloses the monitoring circuit 130 and may be composed of any suitable material for protecting a circuit, such as plastic, metal, molded PCB and the like. The first connector 124, second connector 126, and third connector 128 are electrically coupled with the monitoring circuit 130 inside the housing.

The first connector 124 and the second connector 126 are adapted to fit between an electrical connector 152 tied to vehicle power and the vehicle power outlet 150 having an outlet connector 154. The first connector 124 is adapted to couple with the outlet connector 154 on the vehicle power outlet 150. The outlet connector 154 is typically a female connector, and therefore, the first connector 124 may be a male type connector sized to mate with the outlet connector. In the embodiment shown in FIG. 4, the power outlet is a cigar lighter. The cigar lighter 150 includes the outlet connector 154 and an igniter receiving portion 156. The first connector mates with the outlet connector 154, thereby enabling the igniter receiver portion 156 to couple with another device.

The second connector 126, like the outlet connector 154, is adapted to couple with the electrical connector 152. Therefore, the second connector 126 may resemble the size and shape of the outlet connector 154 in order to couple with the electrical connector 152. The electrical connector 152 may be a male type connector that is adapted to interface with the typically female type outlet connector 154. As such, the second connector 126 may be a female type connector sized to mate with the electrical connector 152, although other types of connectors may be used. The electrical connector 152 couples with the power distribution box 18 to provide current limited power to the electrical connector. Thus, the second connector 126 can provide current limited power to the adapter 114 from the power distribution box 18 when coupled with the electrical connector 152.

The third connector 128 couples with the monitoring circuit 130 and is adapted to couple the adapter 114 with the controller 16 as previously described.

Figure 8:
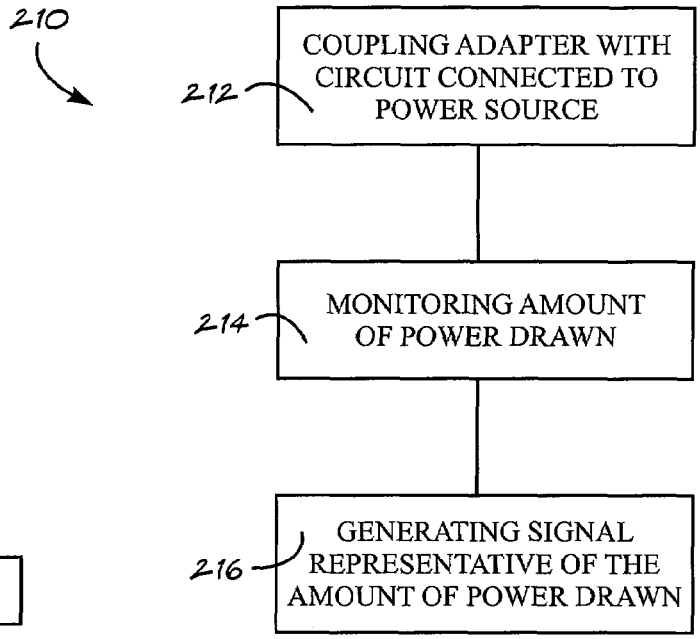
FIG. 8 is a flow chart of an embodiment of an exemplary method of providing power to a vehicle accessory.

FIG. 5 shows an embodiment of the monitoring circuit 130 for adapter 114. The monitoring circuit 130 includes a power-monitoring device 140 to monitor the amount of power drawn through the adapter 114 as described with reference to device 40 in the earlier embodiment. A voltage-stabilizing device 158, such as a zener diode, may be located in the monitoring circuit 130 in parallel with the power-monitoring device 140. The power-monitoring device 140 monitors the amount of current flowing through a portion of the monitoring circuit 130 and provides a monitoring signal representative of that amount of current to the third connector 128. As shown in FIG. 8, the power-monitoring device 140 may be located between the first connector 124 and the second connector 126. The third connector 128 may be located in parallel with the first connector 124 in the monitoring circuit 130. This configuration enables the power-monitoring device 140 to monitor the current flowing through the power outlet 150 and not the controller 16. Alternatively, the monitoring circuit 130 may be otherwise located to monitor the power drawn by both the power outlet 150 and the controller 16 as previously described.

In operation, the electrical connector 152 is disconnected from the power outlet 150, and the adapter 114 is coupled with the controller 16. The first connector 124 is coupled to the power outlet 150, and the second connector 126 is coupled to the electrical connector 152. This configuration enables the controller 16 to obtain current limited power from the power distribution box 18 through the electrical connector 152 and enables the power outlet 150 to remain available to receive other devices and provide power to them. The power-monitoring device 140 monitors all power drawn through the second connector 126. The power-monitoring device 140 generates the monitoring signal representative of the power drawn through the second connector 126.

Referring again to FIG. 1, the controller 16 may include a housing 60, several connectors 62, 64, 66, 68, a logic circuit 70, and a control circuit 72. The housing 60 encloses the controller's circuitry and supports the connectors. A first connector 62 electrically couples the controller 16 with the adapter 14; a second connector 64 couples with the input device 20; and a third connector 66 and a forth connector 68 couple with the vehicle accessories 12.

Figure 6:
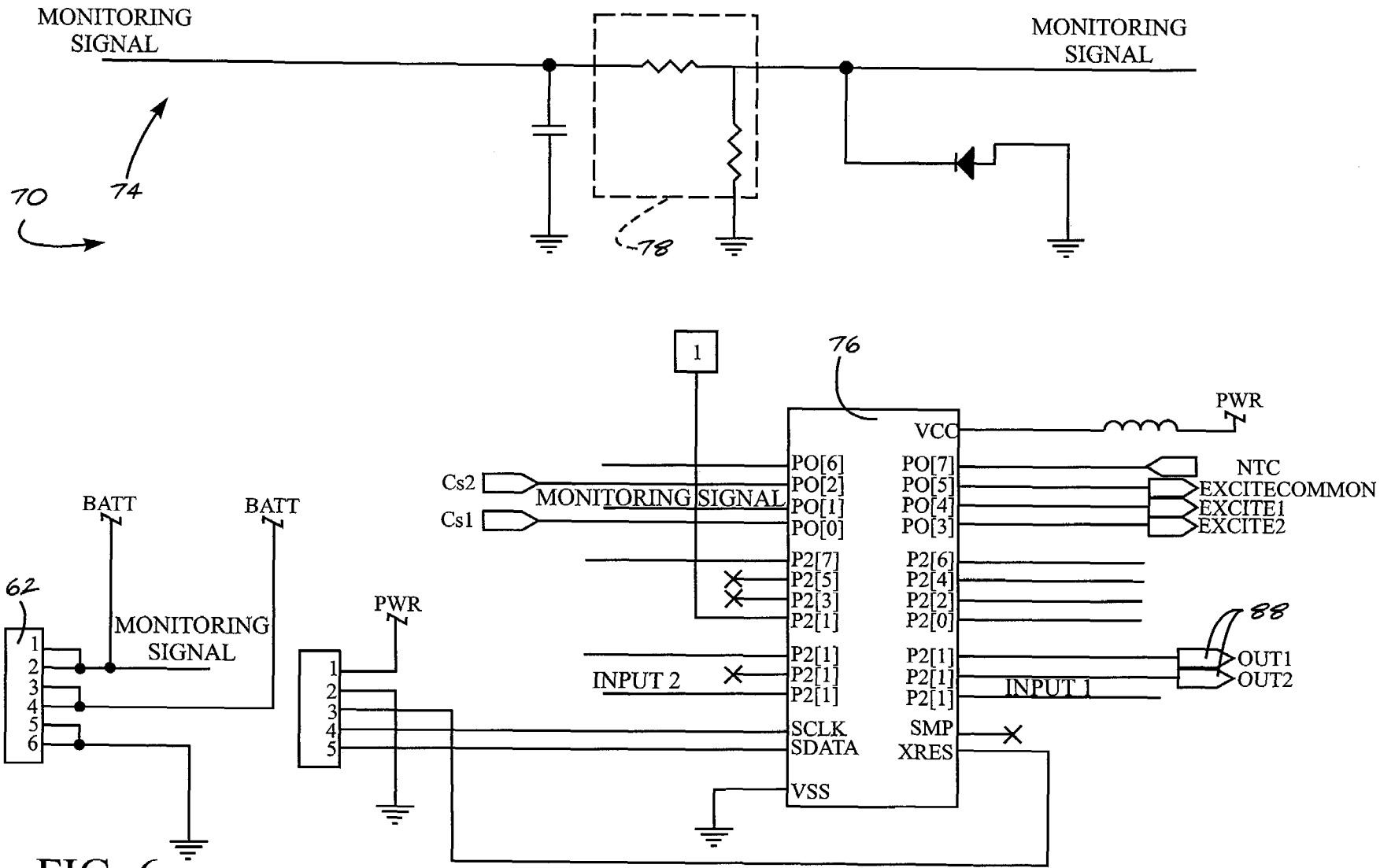
FIG. 6 is a schematic of an embodiment of a logic circuit in a controller of the control system of FIG. 1.

FIG. 6 shows the logic circuit including the first connector 62, conditioning circuitry 74, and a microprocessor 76. The first connector 62 provides power and the monitoring signal to the logic circuit from the adapter 14. The conditioning circuitry 74 may include a pair 78 of resistors in parallel with one another to transfer the monitoring signal from a ground-referenced current signal to a corresponding voltage signal that the microprocessor can handle. The pair 78 of resistors divides down the monitoring signal to a voltage level that the microprocessor 76 can handle (typically five volts). In one embodiment, the conditioning circuitry 74 may also couple with input signals from the input device 20. The conditioning circuitry 74 may condition the input signals for the microprocessor 76 or provide excitation for the input device 20, such as with a constant voltage or current source.

The microprocessor 76 is coupled with the conditioning circuitry 74 and the control circuit 72. The microprocessor 76 may also couple with the input device 20 through the second connector 64 and/or the conditioning circuitry 74. The microprocessor 76 may contain memory, such as RAM or ROM, to store instructions for controlling the vehicle accessory and logic circuitry for executing the instructions. The microprocessor 76 may also contain several input lines to receive information for processing and several output lines for controlling the vehicle accessory 12. The microprocessor may also include output lines (EXCITE1, EXCITE2, EXCITE COMMON) to provide power to one or more sensors 84 (FIG. 1) associated with the vehicle accessory 12. The sensors 84 may include temperature sensors, such as thermistors for monitoring the temperature of the seat heaters. The output lines from the microprocessor 76 to the sensors may pass through conditioning circuitry to provide a conditioned signal to the sensors. The microprocessor 76 may also receive output (NTC) from the sensors for use as feedback from the vehicle accessory 12.

Figure 7:
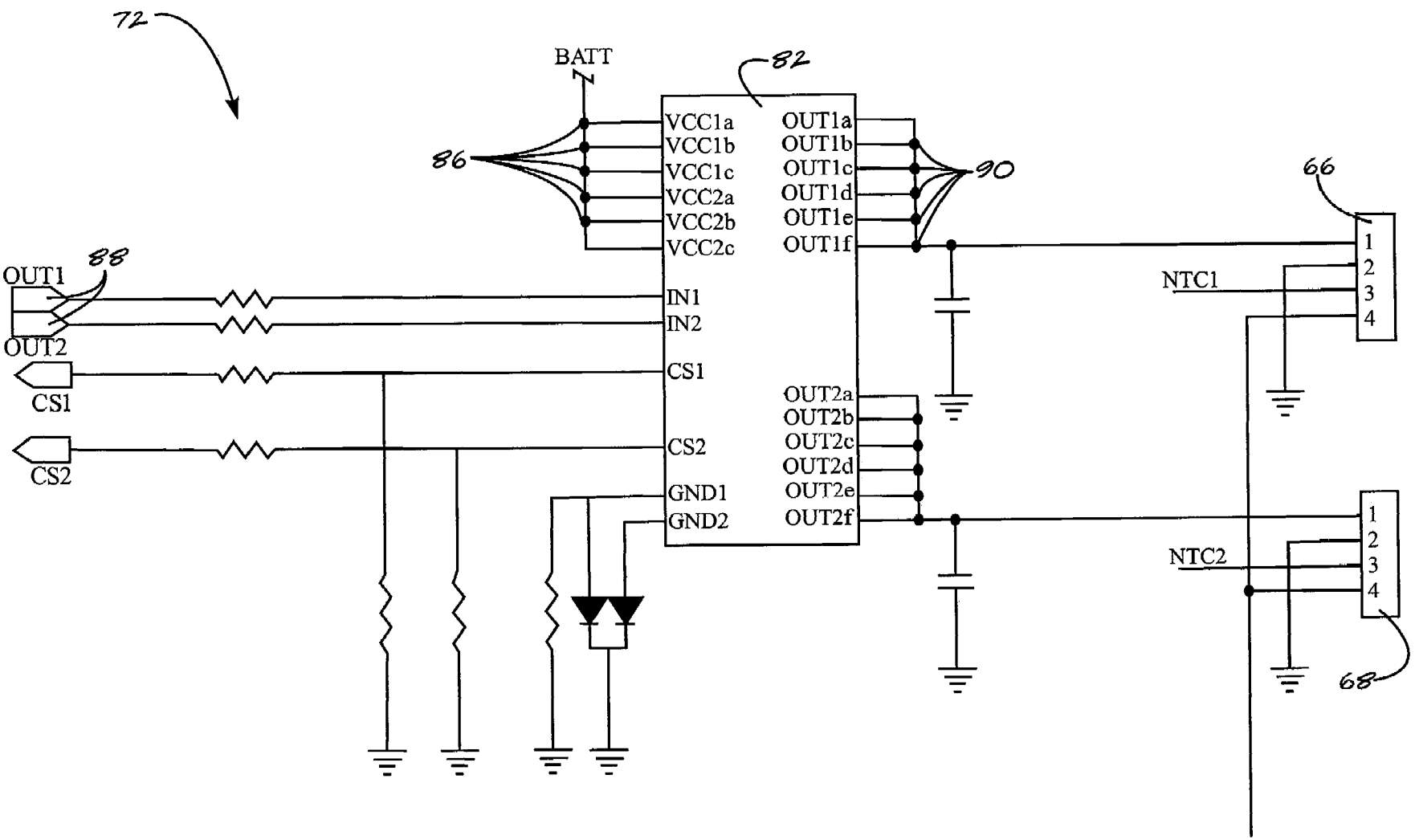
FIG. 7 is a schematic of an embodiment of a control circuit in the controller of FIG. 4.

FIG. 7 shows the control circuit 72 including a relay module 82. The relay module 82 may include any suitable switching device such as solid-state relays, mechanical relays, or any other suitable device. The relay module 82 has inputs 86 tied to vehicle power to provide power to the relay module and the vehicle accessory 12. The relay module 82 receives inputs 88 from the microprocessor 76 to control outputs 90 of the relay module. The outputs 90 of the relay module couple with the vehicle accessory 12 to provide power to the vehicle accessory based upon the inputs from the microprocessor. The control circuit 72 may also include output lines (CS1, CS2) to provide feedback to the microcontroller 76. The feedback may include information related to the amount of power flowing through the outputs of the relay module 82, such as the amount of current drawn by each vehicle accessory 12.

In operation, the control system 10 provides power to the controller 16 from the power distribution box 18 using the adapter 14 as described above. The adapter 14 provides a monitoring signal to the controller 16. The controller 16 may use the monitoring signal to determine the amount of power used by the vehicle circuit. The conditioning circuitry 74 conditions the monitoring signal into a signal compatible with the microprocessor 76. The microprocessor 76 receives the monitoring signal and input commands (INPUT1, INPUT2) from the input device 20. The input commands tell the controller 16 the desired operation of the vehicle accessory 12. In the embodiment shown in FIG. 1, the vehicle accessory 12 is a pair of seat heaters. The seat heaters 12 may include temperature sensors. The microprocessor 76 receives the monitoring signal and the temperature sensor feedback, and determines which seat heater 12 to provide power to, and the amount of power to provide the seat heater 12.

The microprocessor's 76 decision is made based upon whether the current temperature of the seat heater 12 satisfies the input command and the amount of current being used by the vehicle circuit. If the temperature of the seat heaters 12 does not satisfy the input command, the controller 16 may have to provide power to the seat heaters. The total amount of power drawn by the seat heaters 12 and the vehicle circuit must not exceed the threshold. The current limit of the fuse 38 originally located in the socket 26 of the power distribution box 18 provides an indication of the threshold that may be used. The microprocessor 76 determines the amount of power available for the seat heaters 12 based upon the difference between the threshold and the power currently drawn by the vehicle circuit. Based upon the amount of power available for the seat heaters 12, the current temperature of the seat heaters, and the input commands, the microprocessor 76 determines which seat heaters to power, and the amount of power to provide the seat heater. The microcontroller 76 sends command signals 88 to the relay module 82 to control the relay module and provide the necessary power to the seat heater 12 for a particular amount of time. The relay module 82 receives the commands and provides an appropriate amount of power to the seat heaters 12.

Method for Providing Power to a Vehicle Accessory

Turning now to FIG. 8, there is shown an embodiment 210 of a method for providing power to a vehicle accessory. By coupling an adapter to a vehicle power source, method 210 provides power for a vehicle accessory and allows a controller to monitor the amount of current being drawn from the power source.

According to this particular embodiment, method 210 includes at step 212 electrically coupling the adapter 14 with a vehicle circuit that is connected to a fused power source in the vehicle. The fused power source may be a power distribution box 18, a power outlet 150, or any other power source in the vehicle. The adapter 14 may plug into a fuse-receiving socket 36 on the power distribution box 18 to couple the adapter with the fused power source. Alternatively, the fused power source may be a power outlet 150 in the form of a cigar lighter having an electrical connector 152 to couple the cigar lighter 150 to vehicle power. In order to couple the adapter 14 to the cigar lighter 150, the cigar lighter may have to be uncoupled from the electrical connector 152. The adapter 14 may then be coupled to the cigar lighter 150 and the electrical connector 152. In addition, the fused power source may contain a power-limiting device, such as a fuse or circuit breaker to prevent the power drawn from the source from exceeding a threshold. The power-limiting device 38 may be coupled with the power source or may be incorporated into the adapter 14.

At step 214, the adapter 14 monitors the amount of power drawn by the vehicle circuit. The power monitored may include the current or voltage drawn by the vehicle circuit. The adapter may monitor the power drawn by the vehicle circuit by directing all current flowing through the circuit to flow through the adapter 14. The adapter 14 may then measure the current flow.

At step 216, the adapter 14 generates a signal representative of the amount of power drawn by the vehicle circuit. The signal may be a voltage or current may be scaled corresponding to the amount of the current measured by the adapter 14. Alternatively, the signal may include other forms such as a pulse width modulated signal whose pulse width corresponds to the amount of power drawn by the vehicle circuit, a signal with a frequency corresponding to the amount of power drawn by the vehicle circuit, or any other suitable type of signal.

Figure 9:
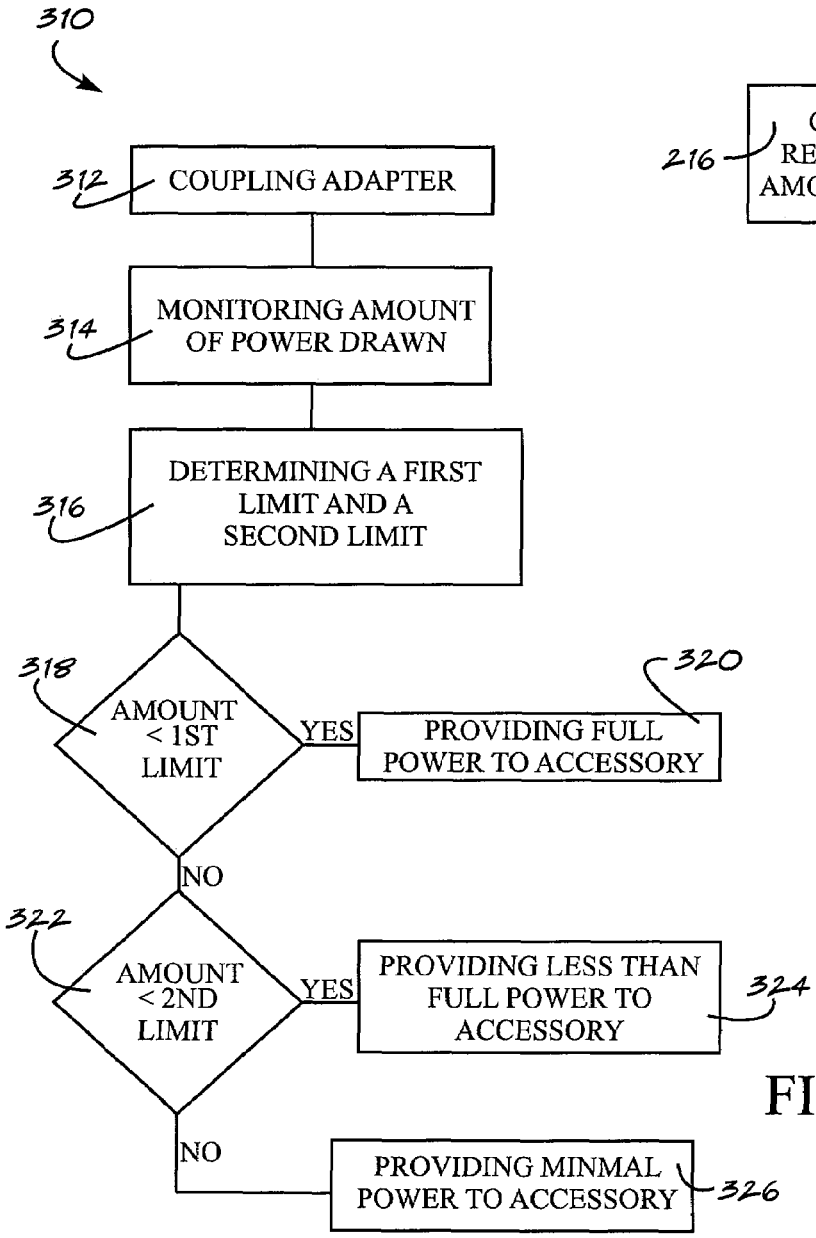
FIG. 9 is a flow chart of an embodiment of an exemplary method of powering a vehicle accessory in a vehicle, which can be carried out using the system of FIG. 1.

FIG. 9 shows another embodiment of a method 310 of providing power to a vehicle accessory. The method 310 determines whether an amount of power required to operate at least one vehicle accessory 12 is greater than the amount of power available to the vehicle accessory from the power distribution box 18 without exceeding the threshold and enables the vehicle accessory to be powered based on the determination.

According to this particular embodiment, method 310 includes at step 312, electrically coupling the adapter 14 with a vehicle circuit connected to a power source in the vehicle. In step 314, the adapter 14 monitors the amount of power drawn by the vehicle circuit.

At step 316, the controller 16 determines a first limit and a second limit. The limits may be determined by the amount of power required to power the vehicle accessories and by the threshold. The threshold defines an amount of power that may be drawn through the circuit without tripping the power-limiting device 38. The threshold may be preprogrammed into the system 10 so that the system interfaces with a vehicle circuit designed to handle at least as much power as the predefined threshold (i.e. fifteen amps, twenty amps, etc.). Alternatively, the threshold may be updated on the controller 16 when the adapter 14 is coupled with the power source, to allow the controller to interface with a variety of power sources and utilize the full amount of power available without exceeding the threshold.

The first limit may be determined by subtracting from the threshold the amount of power required to power all vehicle accessories 12 controlled by the controller 16. For example, if the vehicle circuit has a threshold of twenty-five amps, and two seat heaters 12 require five amps of current each, then the first limit would be fifteen amps. In one embodiment, the amount of power required to power the vehicle accessories 12 is predetermined. Alternatively, the amount of power required to power the vehicle accessories 12 may be determined by the controller 16. The microcontroller 76 may determine the amount of power used by the vehicle accessories 12 by evaluating feedback sent from the relay module 82. The feedback may include information related to the amount of power flowing through the outputs 90 of the relay module 82, such as the amount of current and/or voltage drawn by each vehicle accessory 12 when the controller 16 is powering the accessories.

The second limit may be determined by the difference between the threshold and the amount of power required to power a single vehicle accessory 12. For example, if the vehicle circuit has a threshold of twenty-five amps, and each seat heater 10 requires five amps of current, then the second limit would be twenty amps.

At step 318, the controller 16 determines whether the amount of power drawn by the vehicle circuit is less than the first limit. If the amount of power drawn by the vehicle circuit is less than the first limit, the method continues at step 320. If the amount of power drawn by the vehicle circuit is greater than or equal to the first limit, the vehicle circuit is drawing too much power to power all the vehicle accessories without tripping the power-limiting device 38, and the method continues at step 322.

At step 320, full power is provided to the vehicle circuit and the vehicle accessories 12. For example, the controller 16 may continuously power the vehicle circuit and the all vehicle accessories 12 connected to the controller. The controller 16 is able to continuously power all of the vehicle accessories 12 because the difference between the threshold and the power drawn by the vehicle circuit is large enough to accommodate the power demands of all the vehicle accessories without interrupting power to the vehicle circuit and without tripping the power-limiting device 38. The method 310 ends after step 320.

At step 322, it is determined whether the amount of power drawn by the vehicle circuit is less than the second limit. If the amount of power drawn by the vehicle circuit is less than the second limit, the method continues at step 324. If the amount of power available is greater than or equal to the second limit, the vehicle circuit is drawing too much power to power at least one vehicle accessory 12 without exceeding the threshold, and the method continues at step 326.

At step 324, less than full power is provided to the vehicle accessories 12. The vehicle circuit is drawing too much power to power all of the vehicle accessories 12 without exceeding the threshold. But there is sufficient power available to power the vehicle circuit and at least one vehicle accessory 12 at a time without exceeding the threshold. To power at least one vehicle accessory 12 at a time, the controller 16 may cyclically provide power to the vehicle accessories, but continuously power the vehicle circuit without interruption. In one embodiment, the controller 16 cyclically provides power to the vehicle accessories 12 by repeatedly alternating which vehicle accessory or accessories to power. The vehicle circuit is continuously powered, however, while the controller 16 provides power to one vehicle accessory 12 at a time. For example, the controller 16 may provide power to a first seat heater for a predetermined period, such as 20 seconds, while not providing power to a second seat heater. After the predetermined period has expired, the controller 16 may then provide power to the second seat heater while not providing power to the first seat heater for another period. Thus, the controller 16 would provide power to each of the accessories 12 for an equal period by alternating which accessory to power.

Alternatively, the controller 16 may determine that more than one accessory 12 may be powered at a time, but not all of the accessories. For example, the controller may be coupled with three accessories 12. If the difference between the threshold and the amount of power drawn by the vehicle circuit is sufficient, the controller 16 may power two of the three vehicle accessories 12 at a time and alternate which two accessories to power after the predetermined period.

The controller 16 may adjust the duration that power is applied to each vehicle accessory 12. For example, if the first seat heater heats up faster than the second seat heater, the controller 16 may power the second seat heater for a longer duration than the first seat heater to adjust the rates at which both heaters reach their target temperature. By alternating between which vehicle accessories 12 to power, the controller 16 ensures that the total amount of power drawn by the vehicle accessories and the vehicle circuit do not exceed the threshold. Moreover, alternating the power provided to two or more vehicle accessories 12 allows more than one accessory to operate while the amount of power available is less than the amount required to power all of the accessories.

At step 326, minimal power is provided to the vehicle accessories 12. For example, the controller 16 may provide minimal power to the vehicle accessories 12 because there is not sufficient power to power one vehicle accessory while powering the vehicle circuit without exceeding the threshold. In one implementation, the controller 16 may provide minimal power by not providing any power to the vehicles accessories 12 but continue to power the vehicle circuit. The controller 16 may also provide minimal power by providing just enough power to the vehicle accessory 12 to allow the accessory to power a memory device, a clock, or other such low power components associated with the device.

An example of method 310 is provided. The adapter 14 is coupled with a fuse-receiving socket 36 and receives a fuse 38 having a current limit of thirty amps. In this case, the controller 16 may use thirty amps as the threshold. A vehicle circuit including a vehicle accessory, such as a window defroster, is connected to the fuse-receiving socket 36. The adapter monitors the current draw of the vehicle circuit and the controller 16 determines the first limit. If the controller 16 is coupled to two heaters that each draw ten amps, then the first limit will be calculated by taking the difference of the threshold (thirty amps) and the power required to power both heaters (twenty amps). Therefore, the first limit in this example is ten amps. If the window defroster is drawing eight amps through the vehicle circuit, the controller 16 will determine that it can continuously power both heaters without interrupting power to the window defroster and without blowing the fuse 38. But if the window defroster draws fourteen amps, the controller will determine that the vehicle circuit is drawing more power than the first limit. As such, the controller may determine a second limit. The second limit is twenty amps, calculated by taking the difference between the threshold (thirty amps) and the power required to power just one heater at a time (ten amps). In this case, the current drawn by the vehicle circuit is less than the second limit. Therefore, the controller 16 may power one heater at a time without interrupting the window defroster and without blowing the fuse 38. But if the vehicle circuit begins drawing twenty amps or more (equaling or exceeding the second limit), then the controller 16 will stop providing full power to each heater so that it can avoid interrupting power to the window defroster and avoid blowing the fuse 38.

It is to be understood that the above description is intended to be illustrative and not limiting. Many embodiments will be apparent to those of skill in the art upon reading the above description. For example, the controller 16 may operate with or without the adapter 14. The controller 16 can couple with a power source in the vehicle having a predetermined amount of power available for use by the controller. For example, some vehicles may include a power outlet on its own circuit, so that the only power drawn through the circuit is the power drawn by the controller 16. By determining that all power drawn through the circuit is provided to the controller 16, the controller can provide power to vehicle accessories using the method discussed above.

Additionally, although some of the exemplary embodiments included controlling seat heaters 12, the control system 10 can control other types of vehicle accessories including battery chargers, tire inflation devices, window defrosters, and other suitable devices including aftermarket and OEM devices. Moreover, although the exemplary embodiments show the monitoring circuit 30 as a component of the adapter 14, the monitoring circuit may be a separate component from the adapter. Likewise, the controller 16 may be comprised of separate components. For example, a portion of the control functionality can be incorporated into an OEM vehicle controller. Furthermore, the adapter 14, the controller 16, and the vehicle accessory 12 can be either aftermarket devices or provided by the OEM with the vehicle.

In another arrangement, the adapter 14, the controller 16, and the vehicle accessories can be combined into a single device, thus eliminating the need for various connectors. In another alternative, the controller circuit 76 may be included within the adapter 14. This configuration can allow the control circuit 76 to be adapted to interrupt power to the vehicle accessory 12 and maintain power to the vehicle circuit, or conversely, interrupt power the vehicle circuit and maintain full power to the vehicle accessory 12. Interrupting power to the vehicle circuit may be useful when the vehicle circuit provides power for devices that not require a constant power source in order to function effectively, such as, a seat heater, window defroster, and the like. The controller 16 may be configured to interrupt power to the vehicle accessory 12, the vehicle circuit, or both. The controller 16 can also be part of an OEM vehicle controller to provide power control to the vehicle circuit and/or the vehicle accessories 12.

While certain preferred embodiments have been shown and described, persons of ordinary skill in this art will readily recognize that the preceding description has been set forth in terms of description rather than limitation, and that various modifications and substitutions can be made without departing from the spirit and scope of the invention. The invention is defined by the following claims.

The invention claimed is:

1. An adapter for a vehicle accessory, comprising:

a plug for electrically coupling the adapter with a fuse-receiving socket in a vehicle power distribution box;

a socket electrically coupled with the plug for receiving a power-limiting device;

a circuit electrically coupled with the socket to monitor the amount of power drawn through the adapter, wherein the adapter generates a signal representative of the amount of power drawn through the adapter; and a connector adapted to communicate with a controller that interfaces with an accessory, wherein the signal representative of the amount of power drawn through the adapter is communicated with the controller through the connector.

2. The adapter of claim 1, wherein the signal generated by the adapter is a ground referenced current representative of the amount of current drawn through the adapter.

3. The adapter of claim 1, wherein the signal generated by the adapter is representative of less than the full amount of current being drawn through the adapter and is representative of the amount of current being drawn by a vehicle circuit coupled with the vehicle power distribution box and the adapter.

4. The adapter of claim 1, wherein the power-limiting device is a fuse adapted for insertion into the fuse-receiving socket in the power distribution box.

5. The adapter of claim 1, further comprising an indicator coupled with the plug wherein the indicator indicates that the plug is oriented with the fuse-receiving socket to enable the circuit to monitor the amount of power drawn through the adapter.

6. The adapter of claim 5, further comprising a switch coupled with the indicator to deactivate the indicator.

7. The adapter of claim 1, further comprising a housing carrying the circuit, wherein the plug includes a body extending from the housing to provide a clearance for the housing to extend over a fuse connected to a fuse-receiving socket adjacent to the plug in the power distribution box.

8. The adapter of claim 1 wherein the power drawn by the accessory is communicated with the power-limiting device through the connector.

9. An adapter for a vehicle accessory, comprising:

a first connector for coupling the adapter with a vehicle power outlet;

a second connector for coupling the adapter with an electrical connector through which power is supplied, and wherein the first connector is coupled to the second connector to provide power to the vehicle power outlet; and a circuit electrically coupled with the first connector and the second connector to monitor the amount of power drawn through the adapter, wherein the adapter generates a signal representative of the amount of power drawn through the adapter.

10. The adapter of claim 9, wherein the vehicle power outlet is a cigar lighter having an electrical socket and an igniter receiving portion, and the first connector is adapted to connect to the electrical socket.

11. The adapter of claim 9, wherein the vehicle power outlet is a cigar lighter having an electrical socket and an igniter receiving portion, and the electrical connector is adapted to connect to the electrical socket.

12. The adapter of claim 9, wherein the signal generated by the adapter is a ground referenced current representative of the amount of current drawn through the adapter.

13. The adapter of claim 9, wherein the signal generated by the adapter is representative of the amount of current drawn through the vehicle power outlet.

14. The adapter of claim 9 which also includes a third connector coupled to the second connector and adapted to provide power to a vehicle accessory.

15. The adapter of claim 14 wherein the circuit is electrically coupled with the first connector, the second connector and the third connector to monitor the amount of power drawn through the adapter.

16. A method of providing power to a vehicle accessory, comprising the steps of:

connecting an accessory to an existing circuit connected to a fused power source in the vehicle;

electrically coupling an adapter for the accessory with the existing circuit;

monitoring the amount of power drawn by the existing circuit and the accessory; and generating a signal representative of the amount of power drawn by the existing circuit and the accessory.

17. The method of claim 16, wherein the step of electrically coupling the adapter with the circuit further comprises electrically coupling the adapter to a fuse-receiving socket in a vehicle power distribution box.

18. The method of claim 16, wherein the step of electrically coupling the adapter with the circuit further comprises electrically coupling the adapter to an electrical connector and a vehicle power outlet.

19. The method of claim 16, wherein the step of monitoring the amount of power drawn by the circuit further comprises monitoring the amount of current drawn by the circuit.

20. The method of claim 16, wherein the step of generating the signal representative of the amount of power drawn by the circuit further comprises generating a ground referenced current representative of the amount of power drawn by the circuit.

21. The method of claim 16, further comprising the step of coupling the adapter to the vehicle accessory to provide power to the vehicle accessory from the fused power source.

22. A control system for a vehicle accessory, comprising:

an adapter electrically coupled with a circuit connected to a vehicle power distribution box to provide power to the adapter;

a monitoring circuit coupled with the adapter for generating a monitoring signal, said monitoring signal generated to represent the amount of power drawn through the adapter; and a controller coupled with the monitoring circuit to receive the monitoring signal, wherein the controller determines whether an amount of power required to operate the vehicle accessory is greater than the amount of power available to the vehicle accessory from the power distribution box and the controller restricts the amount of power drawn through the adapter based on the determination.

23. The control system of claim 22, wherein the controller is coupled to more than one vehicle accessory and determines whether an amount of power required to operate all vehicle accessories coupled to the controller is greater than the amount of power available to the vehicle accessory from the power distribution box and the controller enables the vehicle accessories to be powered based on the determination.

24. The control system of claim 22, wherein the controller comprises:

a logic circuit coupled with the monitoring circuit to receive the monitoring signal and make the determination; and a control circuit to enable the vehicle accessory to be powered based on the determination.

25. The control system of claim 22, wherein the monitoring circuit further comprises a monitoring device for measuring the amount of current drawn through the adapter by the circuit and for generating a current representative of the amount of current drawn by the circuit.

26. The control system of claim 22, wherein the adapter further comprises:

a plug for electrically coupling the adapter with a fuse-receiving socket in a vehicle power distribution box; and a socket electrically coupled with the plug for receiving a power-limiting device.

27. The control system of claim 22, wherein the adapter further comprises:

a first connector for coupling the adapter with a vehicle power outlet;

a second connector for coupling the adapter with an electrical connector adapted to connect to the vehicle power outlet.

28. The control system of claim 22, wherein the controller restricts the amount of power drawn through the adapter based on the determination by enabling the vehicle accessory to be powered based on the determination.

29. The control system of claim 22, wherein the controller restricts the amount of power drawn through the adapter based on the determination by enabling the circuit connected to the power distribution box to draw power through the adapter based on the determination.

* * * * *